United States Patent [19]

Sakai et al.

[11] Patent Number: 4,882,987

[45] Date of Patent: Nov. 28, 1989

[54] ATTACHING DEVICE IN A SPRING-CHARGED DOT PRINTER

[75] Inventors: Yasuo Sakai; Morihito Wada, both of Osaka, Japan

[73] Assignee: NEC Home Electronics Ltd., Osaka, Japan

[21] Appl. No.: 180,635

[22] Filed: Apr. 6, 1988

Related U.S. Application Data

[63] Continuation of Ser. No. 942,032, Dec. 15, 1986, abandoned, which is a continuation of Ser. No. 727,830, Apr. 26, 1985, abandoned.

[30] Foreign Application Priority Data

| | | | |
|---|---|---|---|
| Apr. 27, 1984 | [JP] | Japan | 59-62522 |
| May 31, 1984 | [JP] | Japan | 59-111620 |
| Jun. 29, 1984 | [JP] | Japan | 59-134405 |

[51] Int. Cl.[4] ..... B41J 3/10

[52] U.S. Cl. ..... 101/13.04; 101/93.34; 400/157.2

[58] Field of Search ..... 400/121, 124, 124 VI, 400/124 WD, 124 TC, 124 IW, 144, 144.1, 144 A, 157.2, 163.2; 101/93.04, 93.05, 93.29, 93.34, 93.48, 157, 169, 365; 411/154, 155, 156, 531, 544; 267/158, 160

[56] References Cited

U.S. PATENT DOCUMENTS

| | | | |
|---|---|---|---|
| 948,326 | 2/1910 | Hesse | 411/155 X |
| 3,332,464 | 7/1967 | Castel | 411/155 |
| 4,134,336 | 1/1979 | Bringhurst | 101/93.04 |
| 4,393,771 | 7/1983 | Tatsumi | 101/93.04 X |

FOREIGN PATENT DOCUMENTS

| | | | |
|---|---|---|---|
| 217374 | 12/1983 | Japan | 400/124 |
| 1271 | 1/1984 | Japan | 400/124 |
| 348810 | 5/1931 | United Kingdom | 101/169 |
| 364812 | 1/1932 | United Kingdom | 101/157 |

OTHER PUBLICATIONS

American Heritage Dictionary, Houghton Mifflin Boston, MA., 1982, p. 304.

*Primary Examiner*—David A. Wiecking
*Attorney, Agent, or Firm*—Cushman, Darby & Cushman

[57] ABSTRACT

A retaining plate for use in a spring-charged dot impact printing head has a leaf spring confronting surface which mates with the inclined surface of a support, so that mounting members which fix the leaf springs to the support are substantially parallel to the bottom of the support. Also, in order to uniformly distribute pressure to the leaf springs the confronting surface of the retaining plate is curved inwardly.

7 Claims, 3 Drawing Sheets

ATTACHING DEVICE IN A SPRING-CHARGED DOT PRINTER

This is a continuation of application Ser. No. 06/942,032, filed 12/15/86, which was abandoned upon the filing hereof, and which was a continuation of Ser. No. 06/727,830, filed 04/26/85 and now abandoned.

FIELD OF THE INVENTION

This invention relates to a printing head fixing device in a spring-charged dot printer.

BACKGROUND OF THE INVENTION

A conventional printing head section in a spring-charged dot printer is shown in FIGS. 1 and 2. In these figures, reference numeral 1 designates comb-shaped yokes with teeth l*a* on which deenergizing or demagnetizing coils 4 are wound; and reference numeral 2 designates a permanent magnet held between the two base parts l*b* of the two yokes 1. In the printing head section, first end portions 5*a* of leaf springs 5, which include respective printing hammers 6, are attracted to the front ends 1*c* of the teeth 1*a* of the yokes 1. The other end portions 5*b* of the leaf springs 5 are integral with a common base plate 8. The base plate 8 is held by means of fixing screws 10 between a retaining plate 7 and the mounting surface 11 of the lower part of a U-shaped support 3. The two yokes 1, the permanent magnet 2 and the coils 4 are sealingly fixed inside the support 3 with the front ends of the yoke teeth exposed. The support 3 is made of resin or the like.

The leaf spring mounting surface 11 of the support is inclined so that a large spring force is obtained when the upper end portions 5*a* of the leaf springs 5 are attracted to the attracting surfaces 1*c* of the front ends of the yoke teeth.

Mounting holes 12 are used in conjunction with the fixing screws 10 to fixedly secure the base plate 8 of the leaf springs 5 between the retaining plate 7 and the support 3. The fixing screws 10 are mounted so as to be perpendicular to the leaf spring fixing surface 11 of the support 3. The screws 10 are inserted into mounting holes 7*a* formed in the retaining plate 7 and mounting holes 5*d* formed in the lower end portions 5*b* of the leaf springs 5, and are then screwed into the mounting holes 12 in the leaf spring fixing surface.

Accordingly, the mounting holes 12 must be inclined with respect to the bottom 13 of the support. In the case where the support 3 is molded with resin, parts of the mold for forming the external surfaces, such as for instance the bottom, are different in the mold drawing direction from the part of the mold for forming the mounting holes 12. Accordingly, the mold is intricate in construction and costly to manufacture. Furthermore, the mounting members such as the screws 10 must be inclined with respect to the bottom 13 of the support 3 during assembly of the printing head section. Thus, the efficiency in manufacturing the conventional printing head fixing device is low.

Furthermore, the conventional spring-charged dot printer has a leaf spring 5 as shown in FIG. 7. The free end portions 5*a* of a leaf spring 5, which have printing hammers 6, respectively, are attracted to the teeth 1*a* of the yokes. The leaf spring 5 is comb-shaped and has a plurality of teeth 5*c* extending from its fixing part 5*b*. The fixing part 5*b* is held between the support 3 and a clamp plate 7 with fixing screws 10. As is apparent from the above description, the teeth 5*c* of the leaf spring are held on the yoke surface by the magnetic force of the permanent magnet 2. However, when current is applied to the demagnetizing coils 4, the teeth 5*c* are released from the yoke surface, as a result of which strain energy is produced in the leaf spring, thus causing the printing hammers 6 to strike a printing surface to print characters.

In this operation, in order to allow the teeth 5*c* to print characters with the same density, the teeth 5*c* should be uniformly held with respect to elastic energy. Accordingly, it is necessary for the teeth of the leaf spring to be of uniform configuration. Furthermore, in fixing the leaf spring, it is also necessary that the fixing part 5*b* be fixedly secured in such a manner that the conditions of the teeth with respect to the fixing part 5*b* are identical. When the leaf spring 5 is tightened through the clamp plate 7 with the fixing screws 10, the tightening pressure near the fixing screws is higher, and thus the tightening pressure at the fixing part 5*b* of the leaf spring is not uniformly, applied to the free ends 5*a* of the teeth 5*c*. In FIG. 7, the shaded part A indicates a high pressure distribution provided when the leaf spring is tightened through the clamp plate 7 with the fixing screws 10. Because of the tightening screw holes 5*d*, the free ends 5*a* of the teeth 5*c* of the leaf spring 5 are not uniformly tightened, and accordingly characters are printed non-uniformly.

SUMMARY OF THE INVENTION

In order to solve the above-described problems, according to the invention a printing head fixing device uses mounting holes formed in the mounting surface of the support in parallel with the bottom of the support. The retaining plate is made so that, when it is mounted, its one surface brought into contact with the leaf springs is in parallel with the mounting surface of the support and is inclined with respect to the bottom of the support, while the opposite surface on which the heads of the mounting members, such as screws, are seated is perpendicular to the bottom of the support. Therefore, the mounting members are inserted in parallel with the bottom of the support.

Accordingly, although the mounting surface is inclined with respect to the bottom of the support, the directions of the mounting holes in the mounting surface and the direction of insertion of the mounting members are in parallel with the bottom of the support. Therefore, forming the mounting holes in the mounting surface, and inserting the mounting members can be readily achieved thereby improving manufacturing efficiency.

Furthermore, the yokes of the present invention are not inclined, and instead the leaf spring fixing surface of the support is inclined a predetermined angle $\theta$ with respect to the attracting surfaces of the yokes so that the upper end portions of the leaf springs are held substantially vertical when attracted onto the attracting surfaces. As a result, the support is molded so that its leaf spring fixing surface is inclined with respect to the yokes' attracting surfaces. Therefore in sealing the yokes in the support, the yokes can be positioned parallel to the bottom surface of the support. Accordingly the yokes can be positioned accurately, and the angle $\theta$ of inclination can be held constant thereby allowing characters to be printed substantially with uniform density.

The present invention also provides a printing head fixing device in which the fixing ends of the teeth of the leaf spring can be fixedly and uniformly secured through its fixing part. In order to achieve this goal, the surface of the clamp plate or the fixing member which is in contact with the leaf spring is curved inwardly. This allows the base of the leaf spring, i.e., the fixing ends of the teeth to be held under high pressure. As a result, fluctuations in the spring constant and natural frequency of the leaf spring are decreased. Accordingly, characters can be printed with substantially uniform density, and the time required for adjusting the printing density can be greatly reduced.

DETAILED DESCRIPTION OF THE INVENTION

Figure 1:
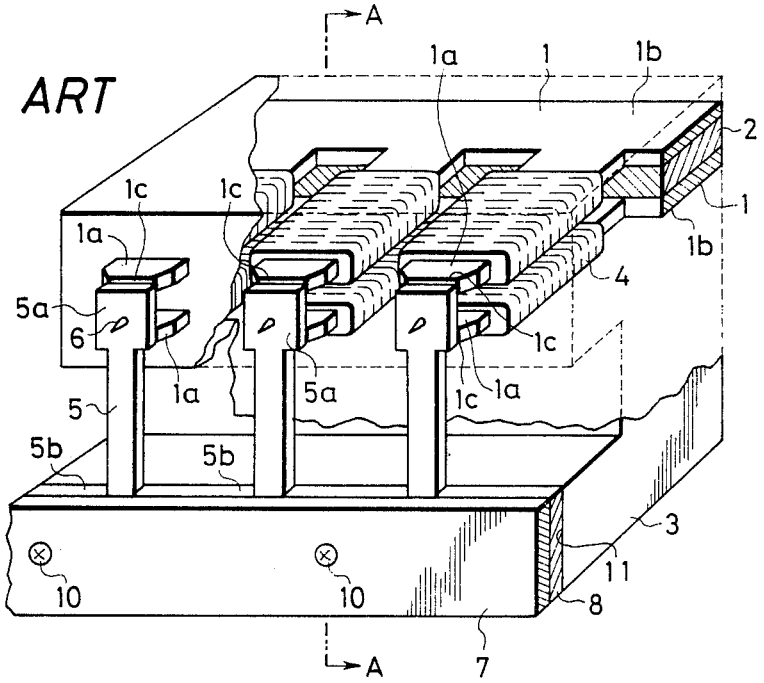
FIG. 1 PRIOR ART
FIG. 1 is a perspective view, with parts cut away, of a conventional printing head fixing device.
Figure 2:
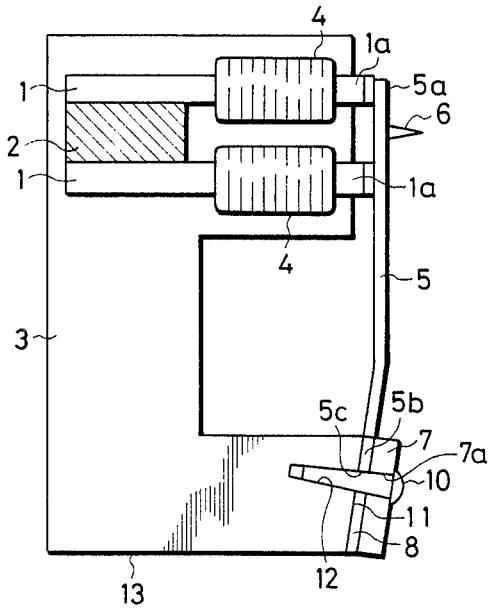
FIG. 2 PRIOR ART
FIG. 2 is a sectional view taken along line A—A of FIG. 1.
Figure 3:
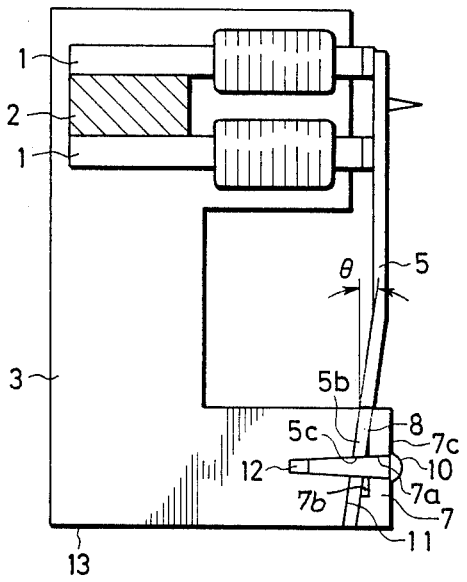
FIG. 3 is a sectional view of one embodiment of the printing head fixing device according to the present invention.

FIG. 3 is a sectional diagram, similar to that of FIG. 2 showing one embodiment of the invention. In FIG. 3, those components which have been previously described with reference to FIGS. 1 and 2 are designated by the same reference numerals or characters.

The retaining plate 7, as can be seen in FIG. 3, is L-shaped in section. When the retaining plate 7 is placed on the mounting surface 11 with the L-shaped surface 7*b* on the lower end portions 5*b* of the leaf springs 5, and the screws 10 are screwed through the mounting holes 7*a* of the retaining plate 7 and the mounting holes 5*c* of the leaf springs 5 into the mounting holes 12 in the mounting surface 11 of the support 3, the outer surface 7*c* of the retaining plate 7, on which the heads of the screws 10 are seated, is perpendicular to the bottom 13 of the support 3. Accordingly, when the leaf springs 5 are fixedly secured with the retaining plate 7 and the screws 10, the screw holes 12 are in parallel with the support's bottom 13. Therefore, in forming the support 3 and the mounting holes, the mold drawing direction of a mold for forming the screw holes 12 can be made parallel to or perpendicular to the mold direction of a mold for forming the external surfaces of the support 3, such as for instance its bottom 13. That is, the support and the screw holes can be easily and readily formed. In addition, as the direction of the screw holes is in parallel with the bottom 13, the screws 10 can be more easily screwed into the screw holes or removed therefrom.

The leaf spring retaining plate 7 in FIG. 3 is L-shaped in section, as described above. Therefore, the retaining plate 7 can firmly push the upper and lower ends of the leaf spring fixing surface of the support when tightened, as a result of which the leaf springs are maintained in a stable condition.

Figure 4:
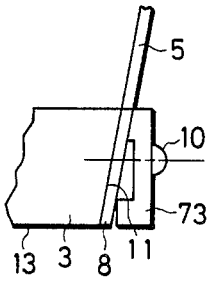
FIG. 4 is a detail view of another embodiment of the present invention.
Figure 5:
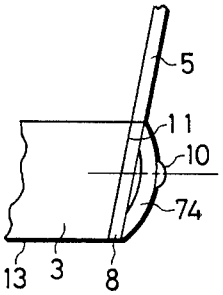
FIG. 5 is a detail view of still another embodiment of the present invention.
Figure 6:
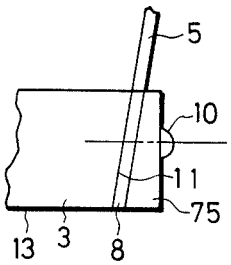
FIG. 6 is a detail view of yet still another embodiment of the present invention.
Figure 7:
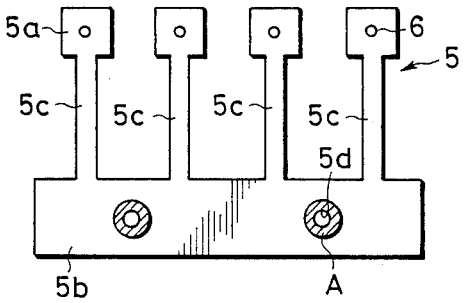
FIG. 7 PRIOR ART
FIG. 7 is a diagram showing a conventional leaf spring used in a printing head fixing device.

In the first above-described embodiment, the leaf spring retaining plate is L-shaped in section. However, the retaining plate may be so modified it is U-shaped, arcuate or trapezoidal in section as shown in FIGS. 4, 5 or 6, as shown by reference numerals 73, 74 and 75, respectively. In these modifications, it is essential that the screws 10 are inserted into the support 3 substantially in parallel with the bottom 13 of the support 3, and the of the screws thus inserted are seated on the plane perpendicular to the bottom 13.

As is apparent from the above description, according to the invention, the mounting holes form the inclined mounting surface of the support are in parallel with the bottom of the support, and the mold drawing direction of the mold for forming the mounting holes can be made parallel to or perpendicular to that of the mold for forming the bottom of the support. Therefore, the molding can be achieved with molds which are simple in construction and low in manufacturing cost as compared to prior art molds. The mounting members such as screws can be inserted into or removed from the support by moving them parallel with the bottom of the support. Thus, the work efficiency in assembling the printing head fixing device is remarkably improved, and the device itself can be more easily handled and assembled.

The printing head fixing device, as shown in FIG. 3, shows that the yokes 1 are not inclined, and instead the leaf spring fixing surface of the support 3 is inclined a predetermined angle $\theta$ with respect to the attracting surfaces of the yokes 1. As mentioned above this feature results in characters being printed with uniform density.

The present invention is not limited to the above-described embodiments only. That is, the technical concept of the invention is applicable to the case also where the yokes are fixedly secured to the top of the support 3 with fixing means such as screws.

Figure 8:
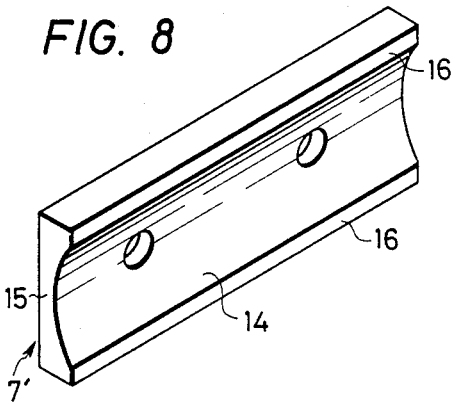
FIG. 8 shows a portion of a leaf spring according to one embodiment of the present invention.
Figure 9:
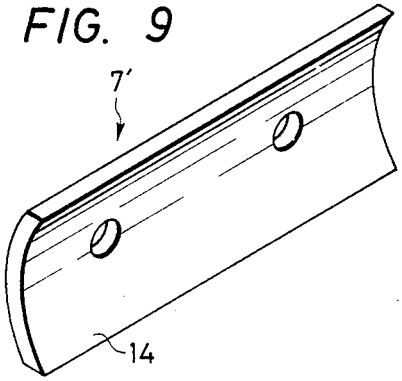
FIG. 9 shows a portion of a leaf spring according to another embodiment of the present invention.

As shown in FIGS. 8 and 9 a clamp plate 7′ is curved, i.e., it has a concave surface 14. The clamp plate is placed on the leaf spring 5 in such a manner that the concave surface 14 confronts the leaf spring 5, and the clamp plate 7′ is tightened with two tightening screws (not shown).

The concave surface 14 can be formed in two different ways as shown in FIGS. 8 and 9. In FIG. 8, the middle part of one surface of a metal plate is machined in the longitudinal direction. The concave surface 14 is arcuate and accordingly, the middle part 15 is the smallest in thickness, and both side parts 16 are the largest in thickness. It is desirable that the side parts 16 are as small in width as possible. In FIG. 9, a metal plate is curved to form a concave surface 14.

Figure 10:
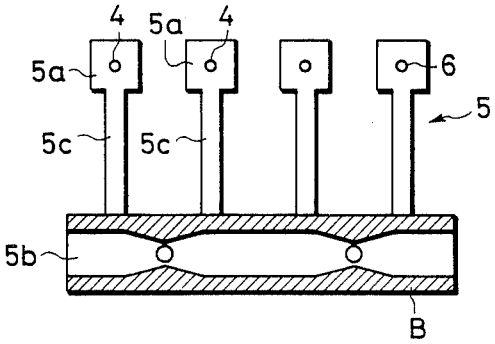
FIG. 10 is a diagram illustrating the improved pressure distribution in a leaf spring according to the present invention.

When the leaf spring 5 is secured to the head fixing member, high pressure is applied to the fixing ends 5*b* of the teeth 5*c* of the leaf spring 5. In FIG. 10, the shaded part B indicates the distribution of high pressure which is, according to the present invention, applied to the leaf spring's fixing part 5*b* by the clamp plate 7′. The fluctuations in the spring constant and natural frequency of the leaf spring 5 are absorbed greatly by the concave surface 14 of the clamp plate 7'. Therefore, characters are printed with substantially uniform density, and the time required for adjusting the printing density can be greatly reduced.

The present invention is not limited to the embodiment shown in FIGS. 8 and 9. That is, the leaf spring holding surface may be machined so as to have a space or groove. For instance, such a space or groove may be formed in the leaf spring mounting surface of the support 3 on which the leaf spring's fixing part **5*b* is mounted. Furthermore, spring's fixing part 5*b*** may be secured according to methods other than by using fixing screws.

It should be appreciated that the above described description of the preferred embodiments do not limit the scope of the present invention in any way, and that various changes and modifications may be made without departing from the spirit and scope of the present invention.

What is claimed is:

1. A retaining plate assembly for use in a spring-charged dot impact printing head which comprises an attracting mechanism including a magnet, yokes and demagnetizing coils, a magnetic force of the magnet being used to attract upper end portions of leaf springs, which carry printing hammers, to the front ends of the yokes against elastic forces of the leaf springs; and a support having an inclined mounting surface on which lower end portions of the leaf springs are mounted, the lower end portions of the leaf spring and the retaining plate assembly being stacked on the inclined mounting surface in the stated order, said retaining plate assembly comprising pressure applying means for applying substantially equal pressure of the leaf springs along the lower end portions thereof, including a member having at least one surface that is inclined with respect to a bottom surface of said support and which defines a recessed portion, said inclined surface of said member mating with said inclined mounting surface of said support, said lower end portions of the leaf spring and said member being stacked on the inclined surface of the support, said member having a second surface opposite said at least one surface, said second surface being perpendicular to the bottom surface of said support, and wherein said member has mounting holes which align with mounting holes in the lower end portions of the leaf springs; and mounting means inserted through said mounting holes substantially in parallel with the bottom of the support, whereby even pressure may be applied by said member to the lower end portions of the leaf springs.

2. A retaining plate assembly as claimed in claim 1, wherein said member is L-shaped and opposite ends of said L-shaped member contact the leaf spring.

3. A retaining plate assembly as claimed in claim 1, wherein said member is U-shaped, one arm of said U-shaped member extending from a base of said U-shaped member a distance greater than the other arm and said member contacts the leaf spring at both arms of said U-shaped member.

4. A retaining plate assembly as claimed in claim 1, wherein the inclined surface of said support and the mating inclined surface of said member maintain the leaf springs tensioned at a predetermined angle when the upper end portions are attracted to the front ends of the yokes.

5. A retaining plate assembly for use in a spring-charged dot impact printing head which comprises an attracting mechanism including a magnet, yokes and demagnetizing coils, a magnetic force of the magnet being used to attract upper end portions of leaf springs, which carry printing hammers, to the front ends of the yokes against elastic forces of the leaf springs; and a support having an inclined mounting surface on which lower end portions of the leaf springs are mounted, the lower end portions of the leaf spring and the retaining plate assembly being stacked on the inclined mounting surface in the stated order, said retaining plate assembly comprising: pressure applying means for applying substantially equal pressure to each of the leaf springs along the lower end portions thereof, including a member having at least one surface that is inclined with respect to a bottom surface of said support and which defines a recessed portion, said inclined surface of said member mating with said inclined mounting surface of said support, said lower end portions of the leaf spring and said member being stacked on the inclined surface of the support, said member having a second surface opposite said at least one surface, said second surface being arcuately shaped, and wherein said member has mounting holes which align with mounting holes in the lower end portions of the leaf springs; and mounting means inserted through the mounting holes substantially in parallel with the bottom surface of the support.

6. A retaining plate assembly as claimed in claim 5, wherein the support and said member maintain the leaf springs tensioned at a predetermined angle when the upper end portions are attracted to the front ends of the yokes.

7. A retaining plate assembly as claimed in claim 5, wherein the surface of said member which confronts the leaf springs is curved inwardly.

* * * * *